US009252519B2

(12) United States Patent
Mori et al.

(10) Patent No.: US 9,252,519 B2
(45) Date of Patent: Feb. 2, 2016

(54) WIRE BRANCHING CONNECTOR

(71) Applicant: NICHIFU TERMINAL INDUSTRIES CO., LTD., Osaka, Osaka (JP)

(72) Inventors: Yoshio Mori, Osaka (JP); Yuji Nakajima, Osaka (JP)

(73) Assignee: NICHIFU TERMINAL INDUSTRIES CO., LTD., Osaka (JP)

( * ) Notice: Subject to any disclaimer, the term of this patent is extended or adjusted under 35 U.S.C. 154(b) by 0 days.

(21) Appl. No.: 14/475,075

(22) Filed: Sep. 2, 2014

(65) Prior Publication Data

US 2015/0072568 A1 Mar. 12, 2015

(30) Foreign Application Priority Data

Sep. 10, 2013 (JP) ..... 2013-187411

(51) Int. Cl.

| | |
|---|---|
| ***H01R 4/24*** | (2006.01) |
| ***H01R 13/10*** | (2006.01) |
| ***H01R 13/46*** | (2006.01) |
| *H01R 13/50* | (2006.01) |

(52) U.S. Cl.

CPC ..... *H01R 13/10* (2013.01); *H01R 4/2433* (2013.01); *H01R 13/46* (2013.01); *H01R 13/501* (2013.01)

(58) Field of Classification Search

CPC .. H01R 4/2433; H01R 4/2429; H01R 43/015; H01R 2201/16; H01R 4/2425

USPC ..... 439/402, 417, 409

See application file for complete search history.

(56) References Cited

U.S. PATENT DOCUMENTS

| | | | | |
|---|---|---|---|---|
| 6,402,541 | B1 * | 6/2002 | Mindeau | H01R 4/2425 439/402 |
| 6,676,437 | B2 * | 1/2004 | Imaizumi | H01R 43/01 439/395 |
| 7,416,434 | B2 * | 8/2008 | Saha | H01R 13/501 439/402 |
| 7,448,900 | B1 * | 11/2008 | Chen | H01R 4/2412 439/402 |
| 8,007,310 | B2 * | 8/2011 | Landis | H01R 4/2433 439/404 |

FOREIGN PATENT DOCUMENTS

| | | |
|---|---|---|
| JP | 11-098676 A | 4/1999 |
| JP | 11-341666 A | 12/1999 |

* cited by examiner

*Primary Examiner* — Phuong Dinh

(74) *Attorney, Agent, or Firm* — McDermott Will & Emery LLP

(57) ABSTRACT

A metal plate contact has two slits running from an upper end towards a bottom wall. First and second trench for receiving trunk and branching cables, respectively, and a recess for mounting a contact that crosses these trenches are created in a middle portion in a lateral direction of a housing. Left and right movable ends are connected to the middle portion on the two sides in a longitudinal direction via a connection band. The movable ends can be folded towards the top of the middle portion. First and second upper side trenches for covering the top of the first trench and covering the top of the second trench, respectively, are created in these movable ends. A wire lid for positioning a cable end is formed in one end or in the two ends of the second trench or of the second upper side trench.

2 Claims, 6 Drawing Sheets

WIRE BRANCHING CONNECTOR

CROSS REFERENCE TO RELATED APPLICATION

This application claims priority to Japanese Patent Application No. 2013-187411 filed Sep. 10, 2013 the subject matter of which is incorporated herein by reference in entirety.

TECHNICAL FIELD

The present invention relates to a wire branching connector with which a branching cable can be branched from a certain point on a trunk cable having an insulating coating that has already been wired or is to be wired without removing the insulating coating.

BACKGROUND ART

A great number of tasks for branching a branching cable from a wired cable or a certain cable, which are regarded as parent cables as described above, have been carried out according to the prior art. In these cable branching tasks the task of removing the insulating coating of the wired cable or the branching cable so as to expose conductive wires requires a great amount of time and effort and, thus, imposes a great burden on workers.

In particular, in the case where the wired cable to which a branching line is to be connected is an active line, it is necessary to make preparations for the task in order to prevent electrical shocking or other unexpected events or, sometimes, it is necessary to implement a temporary power outage and, thus, there is the problem wherein it takes a long period of time for the construction to be completed and the work efficiency is poor.

As a means to solve these problems the present applicant has previously developed and proposed a connector with which the task of safely and quickly leading out a branching line can be carried out without the necessity of performing the task of removing the insulating covering and, at the same time, without the necessity of performing the task of removing the insulating covering from the end of the branching cable even in the case where the wired cable is an active line. This is described in the following Patent Documents 1 and 2.

PRIOR ART DOCUMENTS

Patent Documents

Patent Document 1: Japanese Unexamined Patent Publication H11 (1999)-098676

Patent Document 2: Japanese Unexamined Patent Publication H11 (1999)-341666

SUMMARY OF THE INVENTION

Problem to be Solved by the Invention

The wire branching connectors in these Patent Documents 1 and 2 have significant advantages such that a branching cable can be branched from a certain point on the trunk cable having an insulating covering without requiring the task of removing the insulating covering from either the trunk cable or the branching cable.

However, all of these connectors according to the prior art have a structure wherein the bottom of the contact part (symbol 1 in both documents) having excellent conductivity is pressed against the trunk cable so that the covering of the trunk cable is broken so as to make an electrical connection. Therefore, in the case where the trunk cable is an active line a means for avoiding the risk of leakage of electricity to the tool for applying pressure to the bottom of the contact part is required and, thus, the problem arises such that meticulous attention is required for the task of leading out the branching wire.

Thus, an object of the present invention is to propose and develop a wire branching connector with which the task of the safe and rapid branching can be completed without risking the worker, even in the case wherein the trunk cable is an active line, while retaining the advantages of the wire branching connectors that have been developed according to the prior art wherein a branching cable can be branched from a certain point on the trunk cable without requiring the task of removing the covering.

Means for Solving Problem

The structure of the wire branching connector provided according to the present invention in order to achieve the above object is described using symbols in an embodiment as shown in the following. The structure is made up of a contact 1 made of a metal plate having a high conductivity and a housing 2 made of a synthetic resin having a high degree of insulation, wherein the above described contact 1 comprises two parallel pieces 11, 11 having a U shape as viewed from the side, where two slits 14, 14 are created in each of the parallel pieces 11, 11 beginning at the upper end 12 and running towards the bottom wall 13 with a predetermined distance D in between, the above described housing 2 has a trench 3 for receiving a trunk cable and a trench 4 for receiving a branching cable, which are created in parallel with the distance D in between in a middle portion 21 in the lateral direction, and has a recess 20 for mounting a contact that is created so as to cross these two trenches 3, 4, a left movable end portion 22 and a right movable end portion 23 are formed outside of the middle portion 21 so as to be connected to the middle portion 21 via a connection band 5, 5 so that the left movable end portion 22 and the right movable end portion 23 can be folded toward the top of the middle portion 21, where an upper side trench 31 for covering the top of the trench 3 for receiving a trunk cable is created in one of these movable end portions, and an upper side trench 41 for covering the top of the trench 4 for receiving a branching cable is created in the other of these movable end portions, a bottom wall 13 of the contact 1 is mounted in the above described recess 20 for mounting a contact in a fixed state, where the slits 14, 14 in the contact 1 are located above the trench 3 for receiving a trunk cable and the trench 4 for receiving a branching cable, and a wire lid 6 for positioning a cable end is formed in one end portion or in the two end portions of the above described trench 4 for receiving a branching cable or of the upper side trench 41 for covering the top of the trench 4 in the longitudinal direction.

In addition, in the structure according to claim 2, the wire lid 6 for positioning a cable end in the above structure according to claim 1 is connected by means of an extremely small connection portion 61 in such a state that separation or removal is possible.

Effects of the Invention

As is clear from the above descriptions, in the wire branching connector according to the present invention, a trench for receiving a trunk cable and a trench for receiving a branching cable are created in parallel in the middle portion of the housing with a predetermined distance D in between, and a recess for mounting a contact is created in such a state as to cross these trenches. A left movable end portion and a right movable end portion are formed outside of the middle portion so as to be connected to the middle portion via a connection band so that the left movable end portion and the right movable end portion can be folded towards the top of middle portion, and an upper side trench for covering the top of the trench for receiving a trunk cable and an upper side trench for covering the top of the trench for receiving a branching cable are created in these movable end portions. The bottom wall of the contact is mounted in the recess for mounting a contact in a fixed state where the slits of the contact are located above the trench for receiving a trunk cable and the trench for receiving a branching cable and, therefore, the left and right removable end portions can be folded towards the top of the trunk cable and the branching cable in a state wherein they are placed in the trench for receiving a trunk cable and in the trench for receiving a branching cable by means of connection bands that make folding possible. The folded left and right movable end portions can be simultaneously or independently pressed with a pressing tool from the top so that the insulating covering of each cable is broken while the conductive lines inside of the covering can be made to make electrical contact with the trench for wire connection. At this time the movable end portions of the housing are pressed from above and, therefore, a branching wire can be safely led out even when the trunk cable is an active line in the same manner as in the case wherein the trunk cable is an inactive line. Accordingly, the invention has a significant effect that a branching line can be safely and rapidly branched from a certain point on the trunk cable.

In addition, in the wire branching connector according to the present invention, a wire lid for positioning a cable end is formed in one end portion or in the two end portions of the trench for receiving a branching cable or of the upper side trench for covering the trench for receiving a branching cable from the top in the longitudinal direction. When this wire lid for positioning a cable end is connected in such a state that separation or removal is possible by means of an extremely small connection portion as in the structure according to claim 2, one of the wire lids for positioning in the desired portion can be removed so that one branching cable can be led out while the remaining wire lids (protrusions) make contact with the end of the branching cable. It is also possible to remove two wire lids for positioning at the two ends so that one branching cable can be led out from the two ends of the trench for receiving a cable and, thus, two branching cables are led out. In this case, wire lids for positioning can be easily removed and, therefore, there is such an advantage that a branching cable can be easily and rapidly branched and led out.

PREFERRED EMBODIMENTS

When implementing the present invention it is not necessary to particularly limit the materials to be used. As for the materials for the contact, however, brass and phosphor bronze plated with tin are preferable from the point of view of good conductivity, hardness against cutting of the wire coating, and long-lasting rust resistance. In addition, polyamide-based synthetic high polymers, particularly 6-6 nylon, are preferable as the material for the housing from the point of view of the appropriate flexibility, bending properties, and toughness against cracking.

First Embodiment

In the following, the embodiments of the present invention are described in reference to the drawings. FIGS. 1 through 20 show the wire branching connector according to the first embodiment of the present invention. As shown in the plan diagram of FIG. 1, the entirety of the housing 2 for covering the outside of the below described contact 1 in such a manner that the contact 1 is mounted and coated with insulation is in a rectangular shape which is long in the lateral direction.

Figure 1:
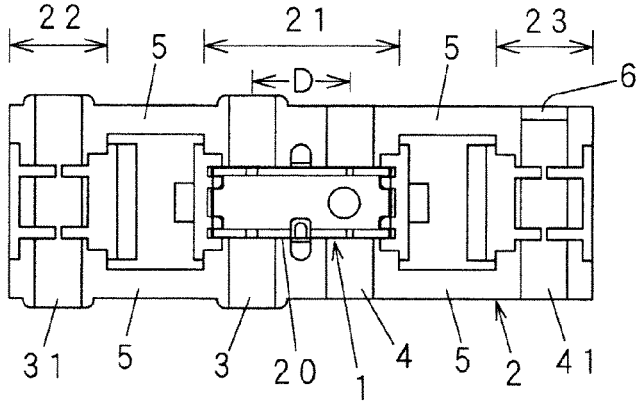
FIG. 1 is a plan diagram showing the first embodiment.
Figure 2:
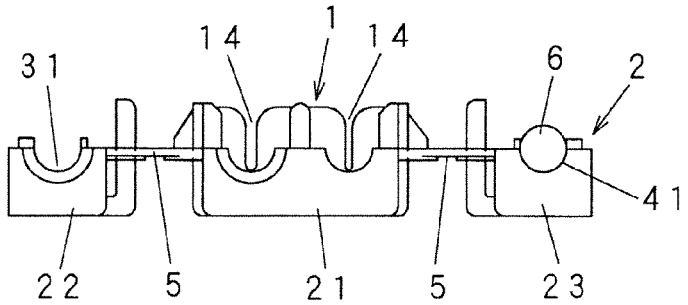
FIG. 2 is a front diagram showing the first embodiment.
Figure 3:
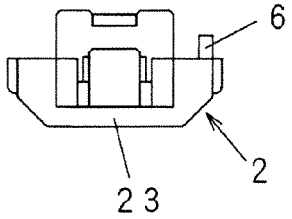
FIG. 3 is a right side diagram showing the first embodiment.
Figure 4:
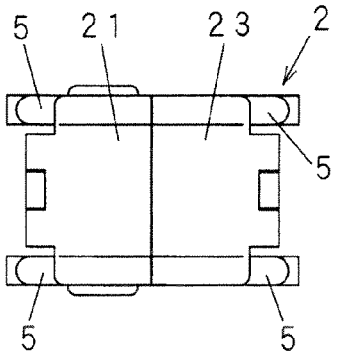
FIG. 4 is a plan diagram showing the assembled state.
Figure 5:
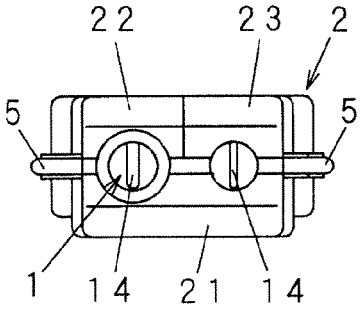
FIG. 5 is a front diagram showing the assembled state.
Figure 6:
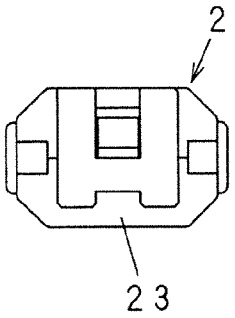
FIG. 6 is a right side diagram showing the assembled state.
Figure 7:
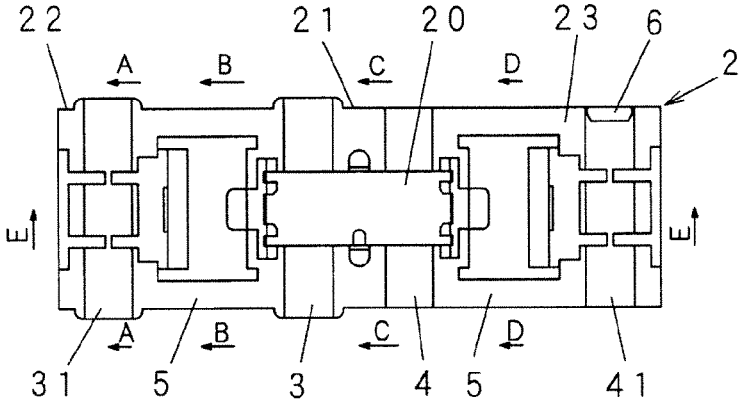
FIG. 7 is a plan diagram showing a housing.
Figure 8:
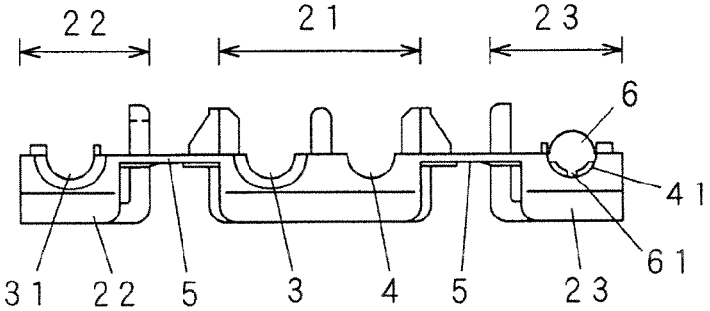
FIG. 8 is a front diagram showing the housing.
Figure 9:
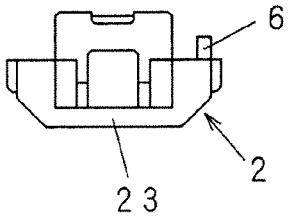
FIG. 9 is a right side diagram showing the housing.
Figure 10:
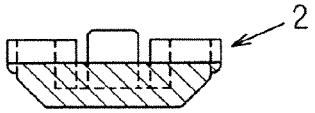
FIG. 10 is a cross sectional diagram along line A-A of FIG. 7.
Figure 11:
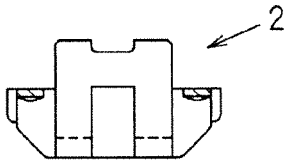
FIG. 11 is across sectional diagram along line B-B of FIG. 7.
Figure 12:
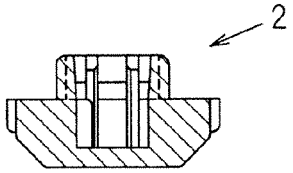
FIG. 12 is a cross sectional diagram along line C-C of FIG. 7.
Figure 13:
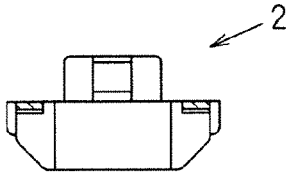
FIG. 13 is a cross sectional diagram along line D-D of FIG. 7.
Figure 14:
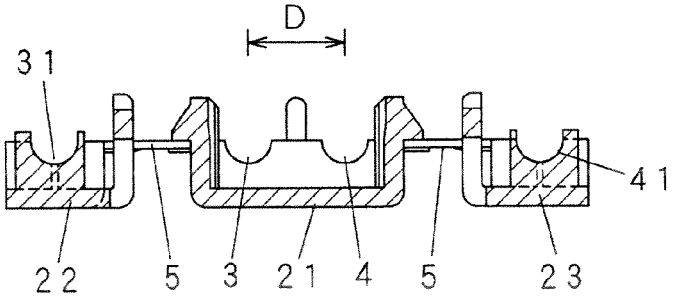
FIG. 14 is a cross sectional diagram along line E-E of FIG. 7.

As shown in FIG. 1, in this housing 2, a middle portion 21 is formed in a predetermined section in the middle of the entirety in the longitudinal direction (left-right direction in FIG. 1). In this middle portion 21, as shown in FIG. 2, two trenches, left and right, in a semi-arc form as viewed from the front are created in parallel as a trench 3 for receiving a trunk cable and a trench 4 for receiving a branching cable with a predetermined distance D in between. In addition, a recess 20 for mounting a contact, which is laterally long enough to cross the two trenches 3 and 4, is formed in the middle in the width direction (from top to bottom direction in FIG. 1).

A left movable end portion 22 and a right movable end portion 23 are formed on the left and right of the middle portion 21 via a connection band 5, 5 having a flexibility that makes folding possible along either side in the above described width direction. In the present embodiment, an upper side trench 31 for covering the top of the above described trench 3 for receiving a trunk cable is created in the left movable end portion 22 from among the two movable end portions 22 and 23 and an upper side trench 41 for covering the top of the above described trench 4 for receiving a branching cable is created in the right movable end portion 23.

Figure 17:
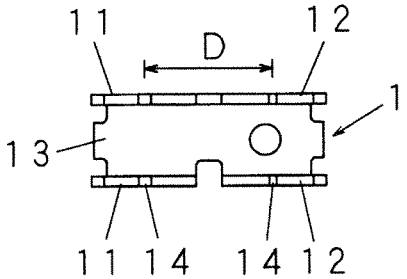
FIG. 17 is a plan diagram showing a contact.
Figure 18:
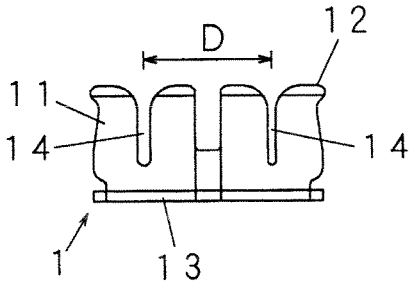
FIG. 18 is a front diagram showing the contact.
Figure 19:
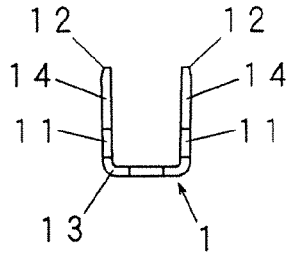
FIG. 19 is a right side diagram showing the contact.
Figure 20:
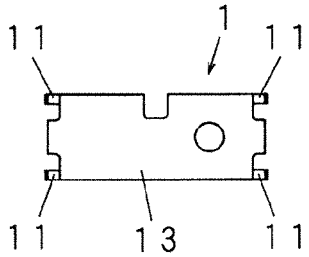
FIG. 20 is a bottom diagram showing the contact.

The above described contact 1 is provided by plating a brass plate or a phosphor bronze plate with tin before or after formation of the plate and, thus, has two parallel pieces 11, 11 that are formed into a U shape as viewed from the side by means of a punching process and a bending process as shown in FIGS. 17 and 19. Two slits 14, 14 beginning at the upper end 12 and running toward the bottom wall 13 are created in each of these parallel pieces 11, 11 with the distance D in between as shown in FIG. 18, where the distance D is the same as the distance D between the trench 3 for receiving a trunk cable and the trench 4 for receiving a branching cable in the above described housing 2.

The bottom wall 13 of the contact 1 is engaged into the above described recess 20 for mounting a contact that is created in the middle portion 21 of the housing 2 so as to be fixed in position. In this fixed state slits 14, 14 created in the parallel pieces 11, 11 of the above described contact 1 are located along the center lines of the trench 3 for receiving a trunk cable and the trench 4 for receiving a branching cable.

In addition, a wire lid 6 for positioning a cable end is formed in the housing 2 according to the first embodiment as a stopper for positioning the end portion of the branching cable that is denoted by 6 in one end portion (upper end in FIGS. 1 and 7) of the trench for receiving a branching cable.

Figure 15:
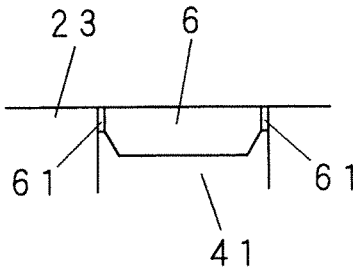
FIG. 15 is a plan diagram showing an enlargement of a wire lid for positioning a cable end.
Figure 16:
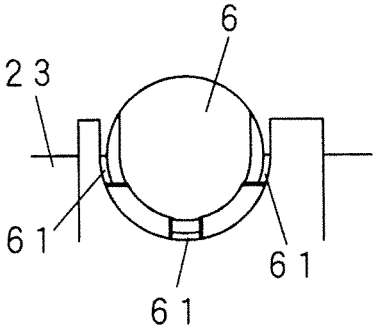
FIG. 16 is a front diagram showing this enlargement.

As shown as enlarged in FIGS. 15 and 16, the wire lid 6 for positioning a cable end according to the first embodiment is connected to the periphery of the upper side trench 41 through three extremely small connection portions 61 on the lower end and two sides in such a state that these extremely small connection portions 61 make separation and removal possible.

Figure 21:
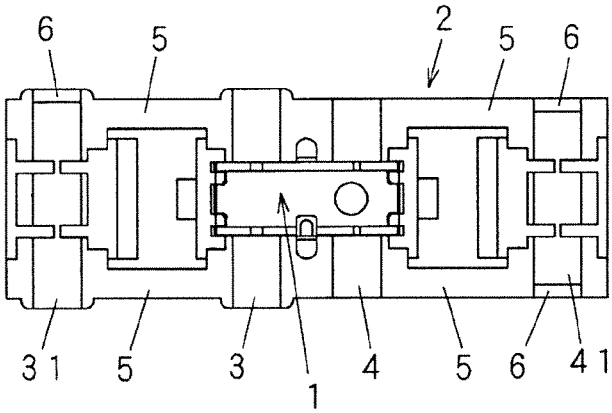
FIG. 21 is a plan diagram showing the second embodiment.
Figure 22:
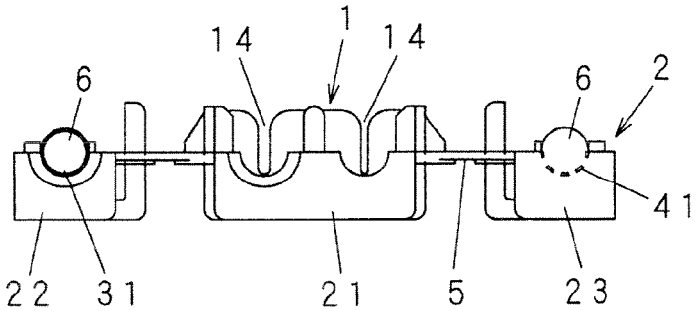
FIG. 22 is a front diagram showing the second embodiment.
Figure 23:
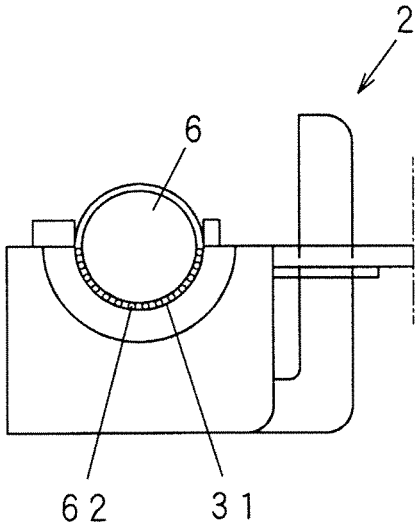
FIG. 23 is a front diagram showing an enlargement of a wire lid for positioning a cable end according to the second embodiment.

FIGS. 21 through 23 show the wire branching connector according to the second embodiment. The wire branching connector according to the second embodiment has such a structure that wire lids 6 for positioning a cable end that are the same as in the first embodiment are formed in the front end portion in addition to in the end portion of the upper side trench 41 for a branching cable. Thus, the invention may be implemented so that the branching cable can be led out in either direction, to the front or to the rear, instead of in only one direction. Furthermore, as shown in FIG. 21, a wire lid 6 for positioning a cable end is formed on one end side of the upper side trench 31 for a trunk cable, that is, in an end portion of the connector according to the second embodiment on the end side.

As shown as enlarged in FIG. 23, a wire lid 6 for positioning a cable end according to the second embodiment, the connection portions between the edge of the trench 31 and the wire lid 6 for positioning a cable end are the remaining portions resulting after perforations 62 have been made.

As described above, wire lids 6 for positioning a cable end may, of course, be formed in the trench 3 for receiving a trunk cable and in the trench 4 for receiving a branching cable in addition to the left and right upper side trenches 31 and 41.

In the case wherein wire lids 6 for positioning a cable end as described above are formed on the two sides, front and rear, of the trenches 3 and 4 for receiving a cable or in the upper side trenches 31 and 41, some wire lids 6 for positioning become necessary while the other wire lids 6 for positioning become unnecessary depending on the directions in which the trunk cable and branching cables are led out. In the case wherein two branch lines are led out from the two sides of the trench for receiving a branching cable, for example, unnecessary wire lids 6 for positioning must be removed. In such a case, the unnecessary wire lids for positioning can be easily removed so that the branching cables can be used because the edge of the trench for creating a wire lid and the wire lid are connected through extremely small connection portions.

Though the representative embodiments of the present invention are described above, the present invention is not necessarily limited to only the structures shown in these embodiments. Appropriate modifications are possible when the present invention is implemented as long as the above described constituent features are provided in order to achieve an object of the present invention and as long as the above described effects of the invention can be gained.

Industrial Applicability

The wire branching connector according to the present invention makes it possible to easily and rapidly lead out a branching cable without risk concerning electricity and, therefore, can be widely utilized by construction workers dealing with electricity.

EXPLANATION OF SYMBOLS

1 contact
11 one parallel piece
12 upper end
13 bottom wall
14 slit
2 housing
20 recess for mounting a contact
21 middle portion
22 left movable end portion
23 right movable end portion
3 trench for receiving a trunk cable
31 upper side trench
4 trench for receiving a branching cable
41 upper side trench
5 connection band
6 wire lid for positioning a cable end
61 connection portion
D predetermined distance

What is claimed is:

1. A wire branching connector, comprising a contact made of a metal plate having a high conductivity and a housing made of a synthetic resin having a high degree of insulation, wherein said contact comprises two parallel pieces having a U shape as viewed from the side, where two slits are created in each of the parallel pieces beginning at the upper end and running towards the bottom wall with a predetermined distance in between, said housing has a trench for receiving a trunk cable and a trench for receiving a branching cable, which are created in parallel with the distance in between in a middle portion in the lateral direction, and has a recess for mounting a contact that is created so as to cross these two trenches, a left movable end portion and a right movable end portion are formed outside of the middle portion so as to be connected to the middle portion via a connection band so that the left movable end portion and the right movable end portion can be folded toward the top of the middle portion, where an upper side trench for covering the top of the trench for receiving a trunk cable is created in one of these movable end portions, and an upper side trench for covering the top of the trench for receiving a branching cable is created in the other of these movable end portions, a bottom wall of the contact is mounted in said recess for mounting a contact in a fixed state, where the slits in the contact are located above the trench for receiving a trunk cable and the trench for receiving a branching cable, and a wire lid for positioning a cable end is formed in one end portion or in the two end portions of said trench for receiving a branching cable or of the upper side trench for covering the top of the trench in the longitudinal direction.

2. The wire branching connector according to claim 1, wherein the wire lid for positioning a cable end is connected by means of an extremely small connection portion in such a state that separation or removal is possible.

* * * * *